US007637035B1

(12) United States Patent
Gillespie

(10) Patent No.: US 7,637,035 B1
(45) **Date of Patent: *Dec. 29, 2009**

(54) COLLAPSIBLE SHOE

(75) Inventor: Andrew Gillespie, North Easton, MA (US)

(73) Assignee: Reebok International Ltd., Canton, MA (US)

( * ) Notice: Subject to any disclaimer, the term of this patent is extended or adjusted under 35 U.S.C. 154(b) by 407 days.

This patent is subject to a terminal disclaimer.

(21) Appl. No.: 11/625,273

(22) Filed: Jan. 19, 2007

Related U.S. Application Data

(63) Continuation of application No. 10/197,256, filed on Jul. 18, 2002, now Pat. No. 7,168,190.

(51) Int. Cl.
*A43B 1/10* (2006.01)

(52) U.S. Cl. ..... 36/102; 36/103; 36/31

(58) Field of Classification Search ..... 36/100, 36/102, 103, 88, 8.3, 9 R, 9 A, 8.1, 31, 7.1 R, 36/7.3, 50.1, 114, 89–92, 170, 45, 51–53
See application file for complete search history.

(56) References Cited

U.S. PATENT DOCUMENTS

| | | | | |
|---|---|---|---|---|
| 500,385 | A | 6/1893 | Hall | |
| 2,068,238 | A * | 1/1937 | Malm | 36/7.3 |
| 2,155,166 | A | 4/1939 | Kraft | |
| 2,188,168 | A | 1/1940 | Winkel | |
| 2,224,590 | A | 12/1940 | Boivin | |
| 2,860,425 | A | 11/1958 | Jackson | |
| 3,148,378 | A | 9/1964 | Tibbitts | |
| 3,634,954 | A | 1/1972 | Larsen et al. | |
| 3,648,109 | A | 3/1972 | Tims et al. | |
| 3,724,107 | A | 4/1973 | Makinen et al. | |
| 3,762,075 | A | 10/1973 | Munschy | |
| 4,043,326 | A | 8/1977 | Little et al. | |
| 4,265,032 | A | 5/1981 | Levine | |
| 4,309,831 | A | 1/1982 | Pritt | |
| 4,309,832 | A | 1/1982 | Hunt | |
| 4,443,511 | A | 4/1984 | Worden et al. | |
| 4,498,251 | A * | 2/1985 | Shin | 36/30 R |

(Continued)

FOREIGN PATENT DOCUMENTS

| | | |
|---|---|---|
| CH | 216930 | 9/1941 |

(Continued)

OTHER PUBLICATIONS

KICKSstyle The International Street Magazine, pp. 54-55, Aug. 20, 2001 (with translation of p. 55).

(Continued)

*Primary Examiner*—Jila M Mohandesi
(74) *Attorney, Agent, or Firm*—Sterne, Kessler, Goldstein & Fox P.L.L.C.

(57) ABSTRACT

An article of footwear including an upper formed of a flexible upper material and a sole formed of a flexible sole material, wherein the sole is rolled, folded, or collapsed onto itself to reduce the volume of the article of footwear. The article of footwear in a collapsed state can then be packaged in a container. This container can be dispensed by a vending machine in a convenient urban area.

27 Claims, 7 Drawing Sheets

U.S. PATENT DOCUMENTS

| | | | | | |
|---|---|---|---|---|---|
| 4,516,336 | A | | 5/1985 | Nissenbaum | |
| 4,631,755 | A | | 12/1986 | Zingg et al. | |
| D288,027 | S | | 2/1987 | Tonkel | |
| RE33,018 | E | | 8/1989 | Ostrander | |
| 4,908,964 | A | | 3/1990 | Deem | |
| 4,944,099 | A | | 7/1990 | Davis | |
| 5,127,170 | A | | 7/1992 | Messina | |
| 5,265,349 | A | | 11/1993 | Munschy | |
| 5,548,910 | A | | 8/1996 | Klingseis | |
| 5,584,077 | A | | 12/1996 | Thrift | |
| D378,472 | S | | 3/1997 | Bramani | |
| 5,832,539 | A | | 11/1998 | Williams | |
| 5,956,868 | A | | 9/1999 | Stevens et al. | |
| D416,669 | S | * | 11/1999 | Parr et al. | D2/954 |
| D421,832 | S | | 3/2000 | Loveder | |
| 6,052,921 | A | | 4/2000 | Oreck | |
| 6,061,929 | A | * | 5/2000 | Ritter | 36/107 |
| 6,115,945 | A | | 9/2000 | Ellis, III | |
| 6,128,835 | A | | 10/2000 | Ritter et al. | |
| D440,031 | S | * | 4/2001 | White | D2/954 |
| 6,298,583 | B1 | | 10/2001 | Allen | |
| 6,367,166 | B1 | | 4/2002 | Barthelemy et al. | |
| 6,584,704 | B2 | | 7/2003 | March | |
| 6,634,121 | B2 | | 10/2003 | Sordi | |
| D492,095 | S | | 6/2004 | Sanchez et al. | |

FOREIGN PATENT DOCUMENTS

| | | | |
|---|---|---|---|
| DE | 201097 | | 11/1907 |
| DE | 1636455 | U | 3/1952 |
| DE | 862102 | | 1/1953 |
| DE | 940756 | | 3/1956 |
| DE | 1914002 | U | 4/1965 |
| DE | 6924927 | U | 6/1969 |
| DE | 1485821 | | 1/1970 |
| DE | 3630738 | | 3/1988 |
| DE | 8907333 | U | 12/1989 |
| DE | 9303653 | U | 6/1993 |
| FR | 1281619 | | 12/1961 |
| FR | 2578725 | | 10/1986 |
| GB | 191228488 | | 12/1912 |
| JP | S59-072901 | | 5/1984 |
| JP | H02-023129 | | 6/1990 |
| JP | H03-012249 | | 3/1991 |
| JP | H04-297201 | | 10/1992 |
| JP | 3011970 | | 3/1995 |
| JP | H08-131201 | | 5/1995 |
| JP | H07-236503 | | 9/1995 |
| JP | 3045628 | | 11/1997 |
| JP | H10-170204 | | 7/1998 |
| JP | 2000-106902 | | 3/2000 |
| JP | 2000-201704 | | 7/2000 |
| JP | 2001-057901 | | 3/2001 |
| JP | 2001-061509 | | 3/2001 |
| JP | 2003-516781 | | 5/2003 |
| NL | 273820 | | 9/1964 |
| NL | 9400255 | | 10/1995 |

OTHER PUBLICATIONS

European Patent Office English language machine translation of DE 1931800.

* cited by examiner

COLLAPSIBLE SHOE

BACKGROUND OF THE INVENTION

1. Field of the Invention

This invention relates to footwear, and more particularly to a collapsible article of footwear, a dispensing apparatus for dispensing footwear, and a method of selling footwear.

2. Background Art

Throughout the course of an average day, the feet and legs of an individual are subjected to substantial impact forces. Running, jumping, walking and even standing exert forces upon the feet and legs of an individual which can lead to soreness, fatigue, and injury. These forces are particularly harsh during concentrated periods of athletic activity or exercise.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain. Thus, it is essential to have cushioning and supporting footwear when engaging in athletic activity. Proper footwear should complement the natural functionality of the foot, in part by incorporating a sole which absorbs the shock caused by athletic activity and supports the natural shape of the foot. However, the sole should also possess enough resiliency to prevent the sole from being "mushy" or "collapsing," thereby unduly draining the energy of the wearer.

Athletic shoes that attend to these features tend to be bulky and sometimes heavy. It is not always feasible to carry a pair of bulky athletic shoes for the purpose of later envisioned athletic activity, particularly if the wearer has a large shoe size. A person may be prevented from performing a desired athletic activity due to the unavailability of proper footwear. In particular, space and weight constraints often limit taking along multiple pairs of shoes while on travel. Often wearers are forced to carry lighter and less bulky foot apparel, such as sandals with a durable sole for athletic activity while traveling. However, sandals may not provide the necessary support. In addition, they leave most of the foot exposed are thus unsuitable for use in colder climates or in places where foot exposure could be dangerous. In addition, the exposure of a sandal does not allow for the additional cushioning and comfort of an upper or a sock liner included with a conventional athletic shoe. A sock worn with a sandal may still not provide sufficient protection from such exposure or be aesthetically pleasing to wear. Furthermore, athletic shoes may be lost, stolen or forgotten while away from home and thus preclude any desired athletic activity.

Accordingly, what is needed is a durable and resilient athletic shoe which is able to provide proper support and cushioning to the foot, but which is also able to be reduced to smaller dimensions so that it may be easily stored, packed or distributed. It is desired that such a shoe be inexpensive to manufacture. Furthermore, it is desirable for such shoe be available in a convenient forum and sold using a method convenient for an on-the-go consumer.

BRIEF SUMMARY OF THE INVENTION

The present invention resolves the above stated problems by providing an article of footwear that includes an upper formed of a flexible, light-weight, breathable upper material, such as a breathable mesh material, and a sole formed of a lightweight, flexible sole material, such as blend of rubber and ethyl vinyl acetate (EVA). The shoe may also have an adjustable network of elastic piping or other closure system to fit snugly against a variety of foot sizes and shapes. The flexible sole and upper allows the article of footwear to be rolled, folded or collapsed on itself so that the article of footwear may be easily stored, packed or distributed. The article of footwear may be folded and stored in a plastic case. The article of footwear may be conveniently sold in areas frequented by those who have left or forgotten athletic shoes while traveling such as airports, train stations, and hotels. It can be used for light workouts because of the support and cushioning of its sole and its flexible fitting, and may also be used as a relaxing or walking shoe. Such a collapsible shoe provides convenience because of its minimal dimensions.

BRIEF DESCRIPTION OF THE DRAWINGS/FIGURES

The foregoing and other features and advantages of the present invention will be apparent from the following, more particular description of a preferred embodiment of the invention, as illustrated in the accompanying drawings in which.

Figure 6C:
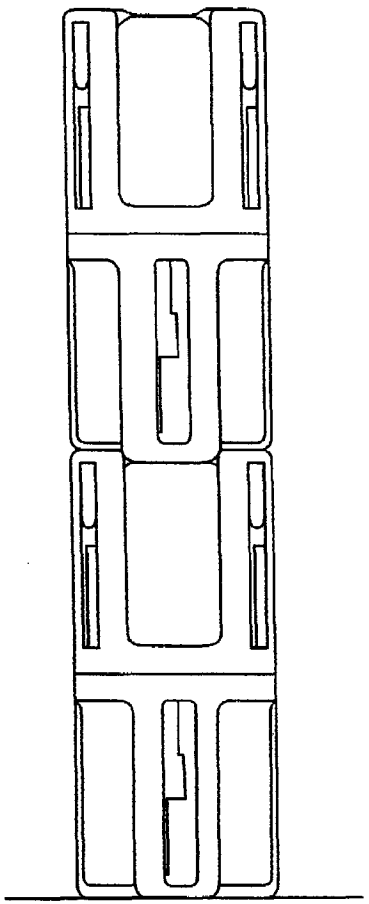
Figure 6B:
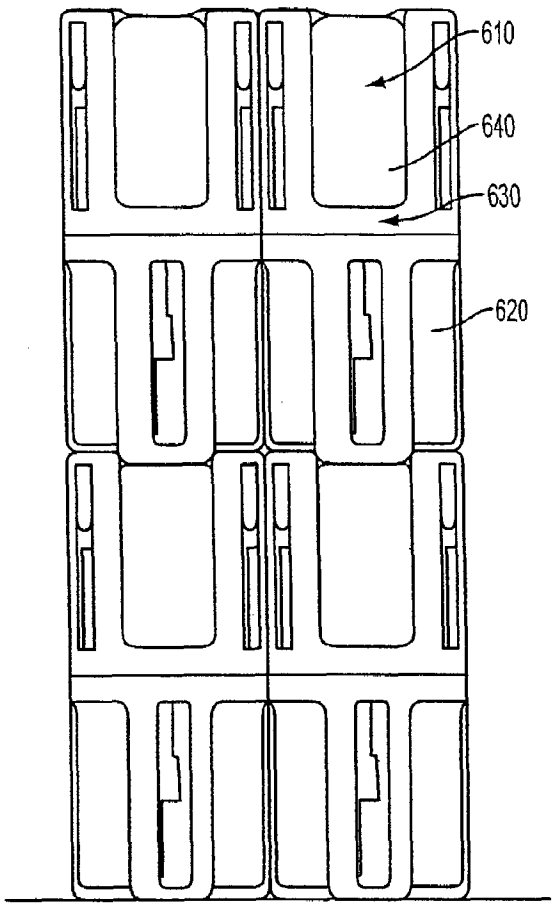
Figure 6A:
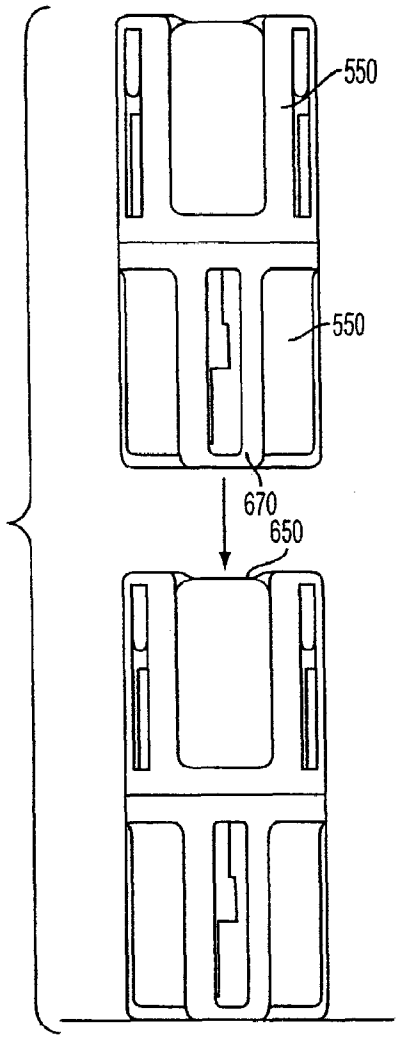
Figure 7:
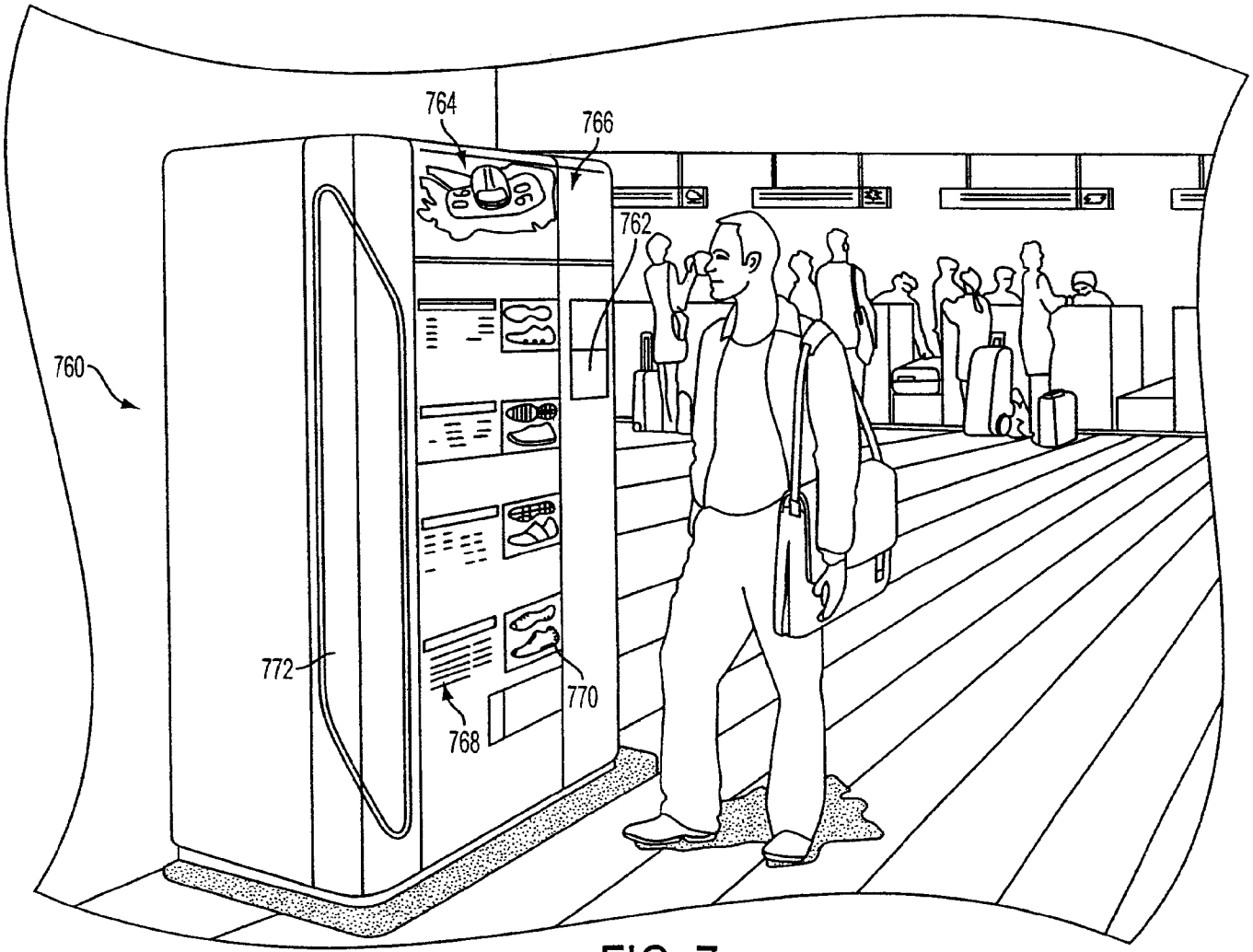

FIGS. 6*a-c* are front views of stacked storage containers according to the present invention in which a shoe of the present invention may be stored or dispensed; and FIG. 7 is a perspective front view of a vending machine according to the present invention for dispensing a shoe of the present invention.

DETAILED DESCRIPTION OF THE INVENTION

A preferred embodiment of the present invention is now described with reference to the Figures, in which like reference numerals are used to indicate identical or functionally similar elements. Also in the Figures, the left most digit of each reference numeral corresponds to the Figure in which the reference numeral is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in other applications.

Figure 1:
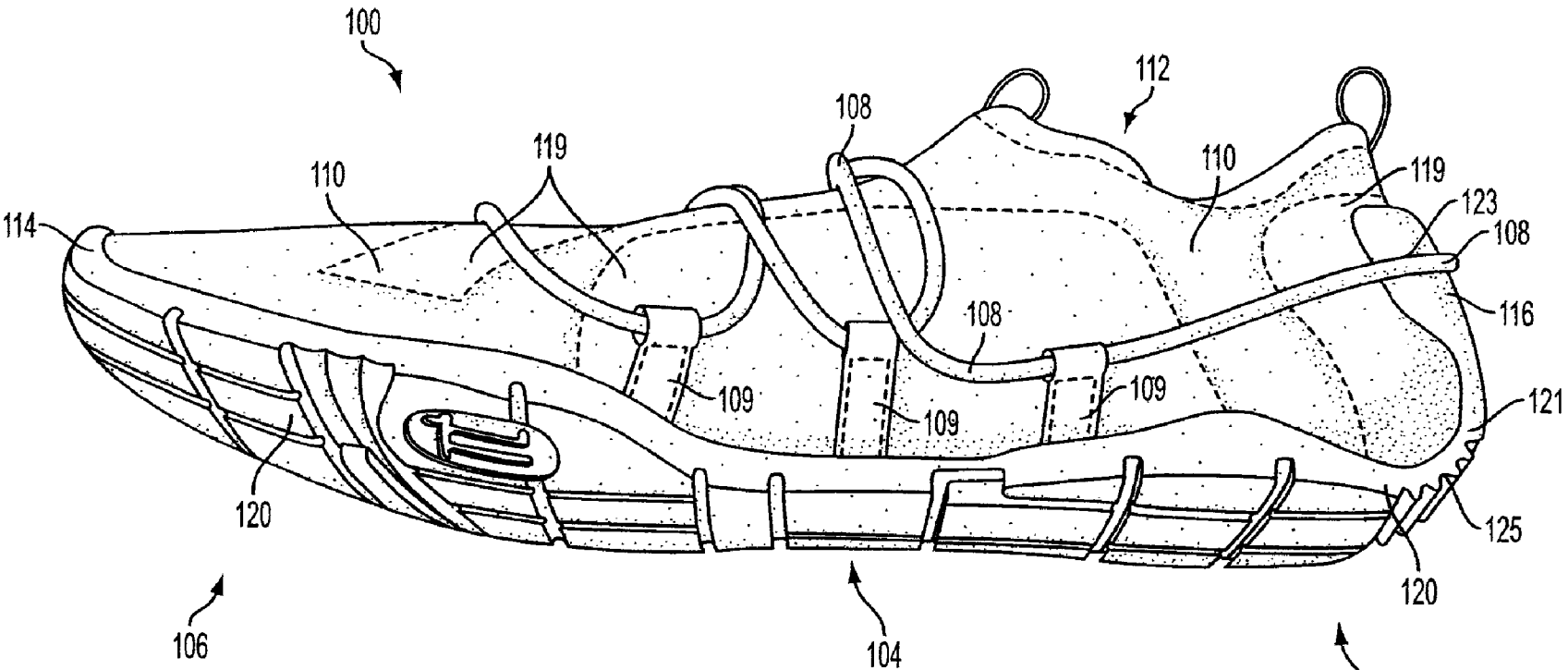
FIG. 1 is a side view of a shoe incorporating the present invention.
Figure 2:
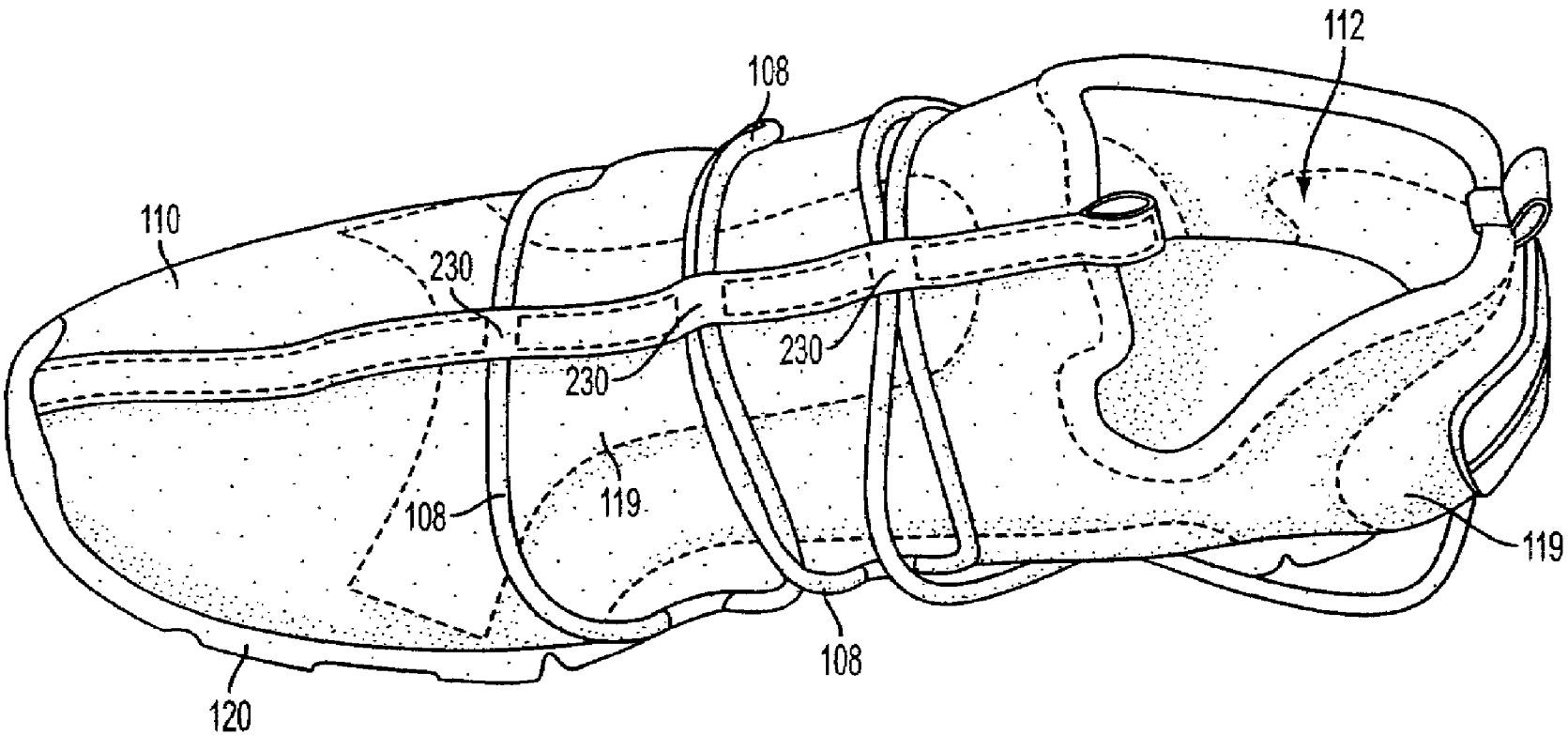
FIG. 2 is a top view of the upper of the shoe shown in FIG. 1.
Figure 3:
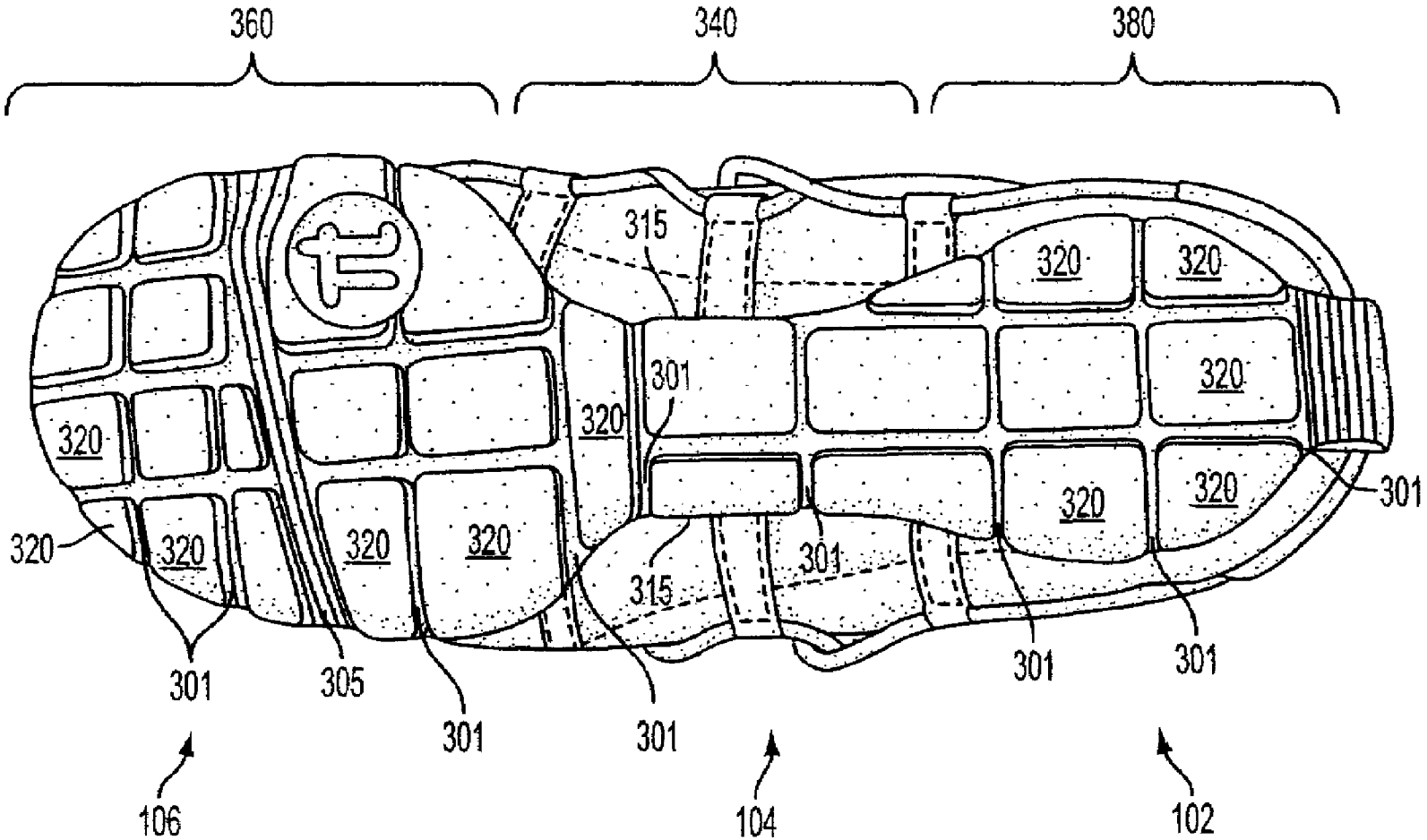
FIG. 3 is a bottom view of the sole of the shoe shown in FIG. 1.

The medial side of a shoe for a right foot according to the present invention is shown generally at 100 in FIG. 1. A corresponding shoe for the left foot would be a mirror image of shoe 100 as would be apparent to one of skill in the art and therefore, is not shown or described herein. As shown in FIG. 1, shoe 100 has a heel area shown generally at 102, an arch area shown generally at 104 and a forefoot area shown generally at 106. Shoe 100 is comprised of an upper 110 and a sole 120. FIG. 2 is a top view of shoe 100 showing upper 110. FIG. 3 is a bottom view of shoe 100 showing sole 120.

Upper 110 is made from a durable and stretchable material such that it provides adequate support to the foot but is flexible enough to be compressed when shoe 100 is collapsed. It is also desirable that the material be breathable to allow air to circulate through the upper without exposing the foot to cold or dangerous elements. A breathable fabric will also allow perspiration of the foot to evaporate and escape. Further, it is desirable that the material be lightweight. In a preferred embodiment, upper 110 is made of a breathable mesh material. In alternate embodiments, upper 110 may be made of any suitable, breathable and stretchable materials, such as spandex, cotton, or the like or combinations thereof or other suitable, stretchable and flexible materials, such as neoprene, as would be apparent to one skilled in the relevant art. Upper 110 may also have at least one padded area 119 with additional layers of the upper material or a lining material to give depth and dimension to the otherwise flexible upper. Padded area 119 may include an inner lining material and a stuffing material or may be several layers that are quilted with additional stitching, for the added comfort of the wearer.

Upper 110 has an ankle opening shown generally at 112, which is designed to receive a wearer's foot. Alternatively, upper 110 may be a conventionally-shaped upper, such as one that contains a conventional tongue.

In a preferred embodiment, shoe 100 includes lacing 108. Preferably, lacing 108 is an adjustable network of elastic piping to allow shoe 100 to fit snugly against a variety of foot sizes and shapes while providing some flexibility as the foot moves through each step. As shown in FIG. 1, lacing 108 may be looped through straps 109. As shown in FIG. 2, shoe 100 may also comprise optional straps 230 along the top of the upper to assure lacing 108 applies pressure in the most desired places on the foot. Flexible lacing 108 also allows ankle opening 112 to expand for the entrance of the foot and then contract pulling upper 110 against the foot to provide support.

A slide connector (not shown) may be employed to cinch together a portion of lacing 108. Such a slide connector may cinch any amount of lacing 108 to adjust the fit of the shoe 100 by drawing the lacing more tightly against the foot. In alternate embodiments, shoe 100 may be tied using conventional lacing made from conventional lacing material or elastic lacing (with or without the use of eyelets), velcro, or another means of attachment that would be apparent to one skilled in the relevant art.

As shown in FIG. 1, a preferred embodiment of shoe 100 further includes a toe plate 114 and a heel plate 116 to provide durability and stability to shoe 100. Preferably, toe plate 114 and heel plate 116 are made from the same material as that used for the flexible sole 120, as discussed below. Alternatively, one or both of the toe plate 114 and heel plate 116 may be made from a different resilient and flexible material, such as thermoplastic polyurethane (TPU) or other material as would be apparent to one skilled in the relevant art. In alternate embodiments, shoe 100 may be constructed without toe plate 114 and/or heel plate 116. Additionally, shoe 100 could alternately include any number of supporting plates or other supporting structures located elsewhere on shoe 100, such as adhered to or stitched onto upper 110. In one embodiment, such plates may form a type of exoskeleton around flexible upper 110.

Heel plate 116 may include a groove 123 through which lacing 108 wraps around the user's heel for a snug fit. Alternatively, heel plate 116 may include a conventional hook or loop (not shown) through which lacing 108 is held in place. Further, a strap similar to strap 109 may be sewn directly onto the upper in the general location of heel plate 116 to allow lacing 108 to pass therethrough. Heel plate 116 may be molded directly with sole 120 or it may be attached to the sole 120 and/or upper 110 separately. In a preferred embodiment, heel plate 116 is formed in a unitary structure with sole 120 and is connected by a connection plate 121, which includes a series of grooves 125. Grooves 125 allow connection plate 121 to bend up from sole 120 along the back of shoe 100 and connect to heel plate 116. In this position, heel plate 116 can provide support to the ankle and heel of a user's foot.

Upper 110 is coupled to sole 120. Additionally, a sock liner may be added inside shoe 100 between the wearer and sole 120, as would be apparent to one skilled in the art.

In a preferred embodiment, as discussed below, the sock liner has flexure points that correspond with flexure points located on the sole 120. The sock liner bends at these flexure points so as not to impede the ability of shoe 100 to roll or fold into a compact and collapsed state.

Sole 120 is preferably made of a flexible, lightweight and durable foam material. More preferably, the sole of the present invention is a lightweight foam material composed of a mixture of ethyl vinyl acetate (EVA), rubber and other compounds, such as the 3D Ultralite material, which is available from The Reebok Company, Canton, Mass. The 3D Ultralite material is a unique mix of polymers that provide good cushioning and prevention of friction, while being lightweight and very flexible while offering excellent road feel, traction, and superior shock absorption. It is preferred that sole 120 is made from a single material so that the construction process is simple. While typical rubber soles slap the pavement, foam outsoles conform to the road for a smoother, more comfortable feel during a typical gait cycle. This material allows sole 120 to provide cushioning and support without the need for a bulky conventional midsole material. Generally, sole 120 should be made of a material which provides full support with a thinner sole which can be easily rolled or folded into a compact shape.

In alternate embodiments, sole 120 may be made of other flexible foam materials or any other suitable flexible material which is lightweight and durable, such as rubber, as would be apparent to one skilled in the relevant art.

As shown in FIG. 3 sole 120 has a relatively flat tread. Alternatively, sole 120 may have anther desired type of tread as would be apparent to one skilled in the art.

Further, sole 120 has cut away portions 315 substantially located at the arch area 104 of the shoe. These cut-away portions 315 narrow sole 120 in the arch area. Nonetheless, the material used to construct sole 120 in combination with a sock liner and heel plate 116, as discussed above, provide full support and cushioning for the foot during athletic activity. Further, the cut-away portions 315 of sole 120 reduce the amount of material in the shoes making it possible to roll or fold shoe 100 even more compactly.

Figure 4:
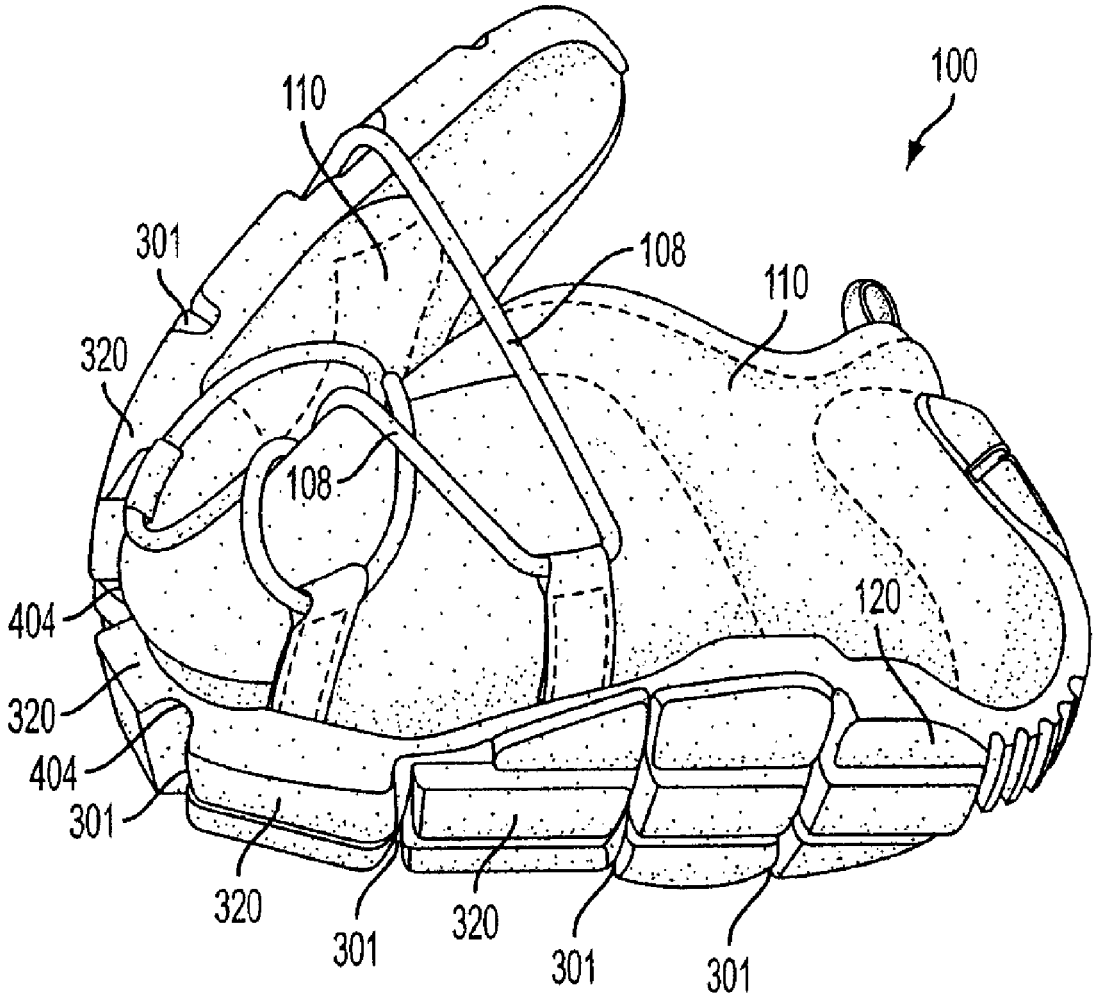
FIG. 4 is a side view of the shoe of FIG. 1 shown partially collapsed.
Figure 5:
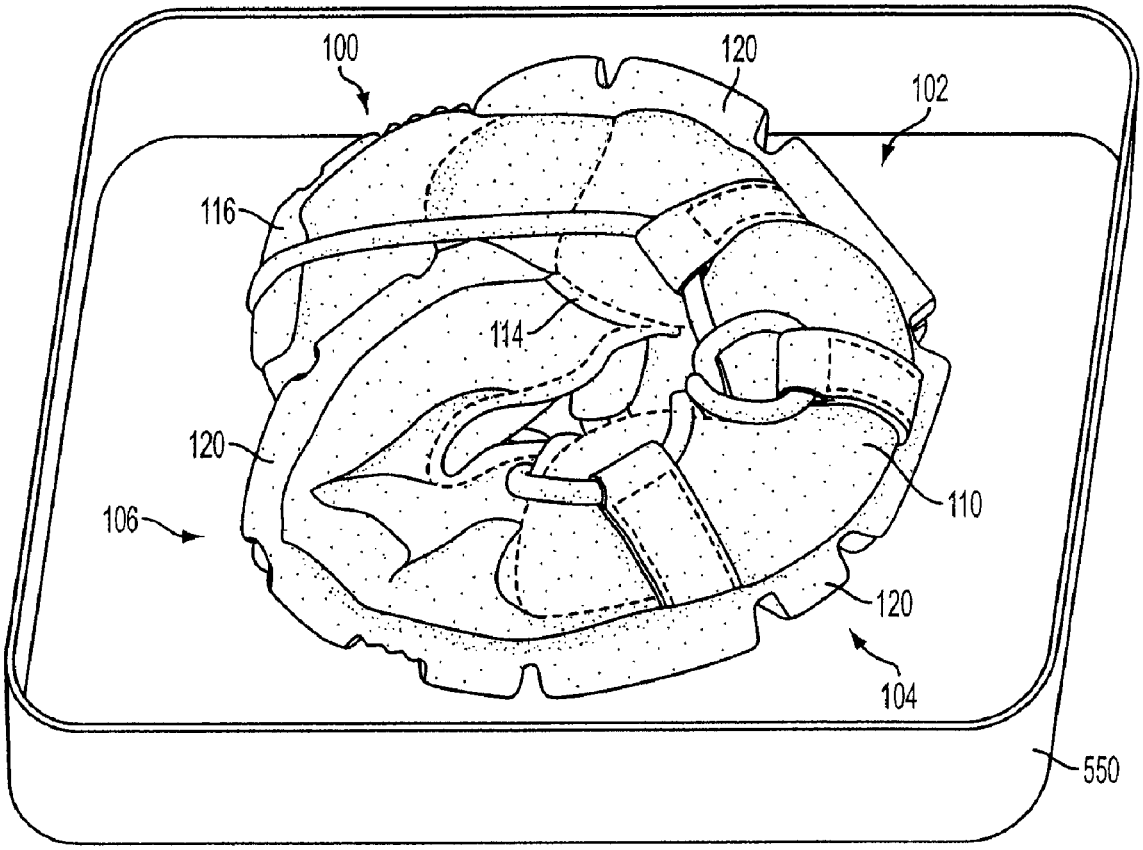
FIG. 5 is a top view of a storage container according to the present invention with a shoe of the present invention shown collapsed and stored therein.

As seen in FIG. 3, sole 120 has a plurality of flexure lines 301, which allow sole 120 to flex and curve. The flexible material of sole 120 allows sole 120 to roll to some extent on its own, but the flexure lines 301 divide the sole into a plurality of sole plates 320 which individually curve around the outside of shoe 100 when in a collapsed state. For example, FIG. 4 shows sole 120 partially rolled or folded onto itself. Lacing 108 and flexible upper 110 are collapsed upon each other, such that flexible sole 120 envelopes the upper 110 and lacing 108. As shoe 100 is rolled, each flexure line 301 allows sole plates 320 to move apart from each other around the outside of the collapsed shoe, as seen at flexure points 404 of FIG. 4, providing more flexibility in sole 120 and a more compact collapsed state for shoe 100. Since FIG. 4 shows a shoe 100 that is only partially collapsed, only the sole plates 320 at flexure points 404 are being affected. However, when all of the sole plates 320 along the length of shoe 100, as shown in FIG. 3, are affected, shoe 100 may be rolled more compactly than that shown in FIG. 4. For example, FIG. 5, shows shoe 100 wherein sole 120 is rolled or folded roughly into thirds. FIG. 5 shows forefoot area 106 sandwiched between heel area 102 and arch area 104. Alternatively, heel area 102 may be sandwiched between forefoot area 106 and arch area 104. Further, shoe 100 may have a cylindrical-shape rather than the flattened sandwich-shape seen in FIG. 5. As discussed earlier, shoe 100 may also include a sock liner with corresponding flexure lines which bend along with sole 120 so as to create a compact shoe.

Sole 120 may comprise one flexure line 301 or more, provided that such flexure line(s) 301 allow shoe 100 to be folded. The more flexure lines that divide sole 120 and the more plates 320 that are created, the more compact sole 120 can become when rolled or folded. For example, one embodiment may have a first flexure point formed from a first flexure line and a second flexure point formed from a second flexure line, so that shoe 100 can be rolled or folded roughly into thirds, similar to the shoe 100 shown in FIG. 5. However, preferably, a greater number of flexure lines 301 are utilized, as seen in FIG. 3. FIG. 5 shows upper 110 and lacing 108 enveloped by sole 120. In an alternative embodiment, however, shoe 100 may be rolled or folded in the other direction, such that sole 120 is enveloped by upper 110 and lacing 108.

Further, FIG. 3 shows a larger flexure line 305 located diagonally across the width of sole 120, generally where a user's toes bend at the end of a typical gait cycle. The larger flexure line 305 provides additional flexibility at this point to provide additional comfort while the foot is in motion. Further, when shoe 100 is rolled or folded starting with the forefoot area 106, the larger flexure line 305 allows the forefoot area to collapse even deeper into the roll of sole 120.

In practice, no matter how the shoe is rolled or compacted, sole 120 has a natural state which is generally flat. Consequently, sole 120 will naturally unroll unless it is held in a compact state, such as by placing shoe 100 into a container. FIG. 5 shows a collapsed shoe 100 fit into a container 550. Container 550 can be easily packed or stored in any convenient location such as a bag, pocket or suitcase. When removed from container 550, sole 120 will automatically unroll to a generally flat natural state.

Preferably, container 550 is large enough to store a pair of shoes 100 packaged together. When left and right shoes 100 are rolled or folded into a compact state, the left and right shoe may stored together in a compact manner in container 550. As seen in FIG. 3, sole 120 has a larger portion 360 generally located in forefoot area 106, a narrower portion 340 generally located in arch area 104 formed from the cut-away portions 315, and a mid-sized portion 380 generally located in heel area 102.

Left and right shoes 100 may be stored side-by-side, such that the larger portion 360 of either the left or right shoe is generally adjacent to the narrower portion 340 of the other of the left or right shoe. In this arrangement, the larger portion 360 of one shoe fits into the cut-away portion 315 of the narrower portion 340 of the other shoe, thereby reducing the amount of space necessary to store a single pair of shoes. Alternatively, the left and right shoe may be packaged one on top of the other, or such that the heel of one shoe is interlocked into the folded portion of the other shoe to form an S-shape with the two shoes. Other methods can also be used to arrange a left and a right shoe 100 within container 550 in a compact manner, as would be apparent to one skilled in the art.

Container 550, as shown in FIGS. 5 and 6*a*-6*c*, is preferably a rectangular case, although in alternate embodiments container 550 may be square, circular, cylindrical or otherwise shaped as would be apparent to one skilled in the relevant art. FIGS. 6*a*-6*c*, shows an outside view of several identical containers 550 stacked together. Preferably, containers 550 are stackable with each other. In a preferred embodiment container 550 may be a plastic container. In alternate embodiments, container 550 may be made of any sufficiently durable material, as would be apparent to one skilled in the relevant art. Further, as seen in FIGS. 6*b* and 6*c*, containers 550 may be a variety of colors.

FIG. 6*b* shows stackable containers 550 having a first side 610 and a second side 620. Container 550 may have a clear portion 640 through which the collapsed shoe may be seen. First side 610 may also have an opaque portion, such as area 630. The opaque portion may have a conventional, plastic, sandblasted texture. However, as discussed above, container 550 may have a variety of outward appearances. Preferably, as seen in FIG. 6*a*, stackable containers 550 have a female end 650 and a male end 670, such that, when stacked, the container temporarily interlock. Stackable containers 550 allow collapsed shoe 100 to be stored in a more compact manner. Further, stackable containers 550 are convenient for dispensing from a dispensing apparatus, such as vending machine 760, of the present invention as discussed below. FIGS. 6*a*-6*c* show that female end 650 and male end 670 interlock when first side 610 of one container 550 faces the same direction as the second side 620 of its adjacent container 550. Any interlocking and/or stackable containers may be used that provide for compact storage of collapsible shoes as would be apparent to one skilled in the art.

A variety of dispensing apparatus would be appropriate for dispensing the collapsible shoe of the present invention. For example, FIG. 7 shows a preferred vending machine 760. Vending machine 760 could be located in an urban area frequented by travelers such as an airport, a rail station, or a hotel. Other locations may include a mall, a health club, or any other area where distributing athletic shoes or other athletic apparel could be useful and convenient.

In a preferred embodiment such as the embodiment shown in FIG. 7, vending machine 760 may include a credit card swipe or conventional means of accepting currency, such as a bill acceptor and coin slots, and a receipt provider located anywhere on the machine, preferably in the area 762. Vending machine 760 also may include a screen 764, which may be connected to the internet or other online computer system or a local computer system or other video distribution means such as a VCR. Screen 764 may display commercials or other messages that could be uploaded daily and be market specific. Preferably, the internet connection is a broadband, hi-speed internet connection to avoid requiring a modem or dial-up service to the vending machine 760. A dedicated connection would require less human operation and interaction with the vending machine 760.

Additionally, an internet connection may provide a feature wherein, if a desired product is not available, vending machine 760 will automatically connect to a warehouse for overnight delivery of the product to the user's destination.

Further, the user may be able to pay for this service via the currency reader or credit card swipe located on the vending machine. Screen 764 may also provide step-by-step instruction on the use of vending machine 760. In a preferred embodiment, vending machine 760 may have audio capability, preferably located in the area 766 to provide audio instructions or descriptions of options for consumers and to provide sound that corresponds to the images displayed on screen 764. Panel 772 may be reverse printed with market specific imagery. Alternatively, images may be inserted into panel 772 so that they can be periodically changed, using techniques known for conventional vending machines.

Vending machine 760 may also have product descriptions 768 and colored images 770, which display the variety of colors and sizes available at one or more vending machines 760 located in the same vicinity. Vending machine 760 could also dispense other products, such as T-shirts, athletic shoes or pants, socks, sports bras, other athletic apparel, or various food or drink products.

While the invention has been particularly shown and described with reference to preferred embodiments thereof, it will be understood by those skilled in the art that they have been presented by way of example only, and not limitation, and various changes in form and details can be made therein without departing from the spirit and scope of the invention. Thus, the breadth and scope of the present invention should not be limited by any of the above-described exemplary embodiments, but should be defined only in accordance with the following claims and their equivalents. Additionally, all references cited herein, including issued U.S. patents, or any other references, are each entirely incorporated by reference herein, including all data, tables, figures, and text presented in the cited references.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. An article of footwear comprising:

an upper; and a flexible unitary sole fixed to said upper and having a forefoot area, a heel area and an arch area, and further having a length and a width, wherein said sole includes:

a first flexure line that extends through at least a portion of the length of said sole and divides said sole at said arch area into first and second sole plates, the first sole plate extending from a lateral side of said sole to said flexure line and the second sole plate extending from said flexure line to a medial side of said sole, wherein a widest portion of the second sole plate is wider than a widest portion of the first sole plate, and wherein the first and second sole plates have a ground contacting surface, and a second flexure line that extends through at least a portion of the length of said sole along at least a portion of said forefoot area, wherein said first flexure line extends longitudinally through at least a portion of said forefoot area, said second flexure line being disposed between said first flexure line and the medial side of said sole, wherein said first and second flexure lines divide said sole at the portion of said forefoot area into third, fourth and fifth sole plates that extend the width of said sole, each of the third, fourth and fifth sole plates being undivided by a flexure line, wherein the third sole plate extends from the lateral side to said first flexure line, wherein the fourth sole plate extends from said first flexure line to said second flexure line, and wherein the fifth sole plate extends from said second flexure line to the medial side of said sole.

2. The article of footwear of claim 1, wherein the third, fourth and fifth sole plates are exposed on an outside of the shoe.

3. The article of footwear of claim 2, wherein only said first flexure line extends substantially the entire length of said sole.

4. The article of footwear of claim 2, wherein the portions of said forefoot area divided by the first and second flexure lines are immediately adjacent said arch area of said sole.

5. The article of footwear of claim 1, wherein said sole further includes a plurality of laterally extending flexure lines that extend across the width of said sole so as to divide said sole into a plurality of sole plates that flex with respect to one another, wherein said article of footwear has a natural state and a collapsed state, said collapsed state having said sole rolled onto itself with said forefoot area disposed adjacent said heel area and said sole enveloping said upper, whereby the plurality of sole plates move apart from each other around the outside of the shoe in said collapsed state.

6. The article of footwear of claim 5, wherein at least one laterally extending flexure line is located diagonally across the width of said sole so as to be slanted with respect to at least one other laterally extending flexure line.

7. The article of footwear of claim 5, wherein said natural state of said article of footwear includes a generally flat sole.

8. The article of footwear of claim 5, wherein said article of footwear is held in said collapsed state by a container.

9. The article of footwear of claim 1, wherein said sole has only nine laterally extending flexure lines that extend across the width of the said sole and are disposed rearward of a front end of said sole and forward of a rear end of said sole.

10. The article of footwear of claim 1, wherein said sole further includes a lateral flexure line extending across the width of said sole at said arch area, wherein a thickness of a portion of said sole for extending beneath a wearer's foot and divided by the lateral flexure line is less than a thickness of said sole not divided by the lateral flexure line.

11. The article of footwear of claim 1, wherein said upper comprises a first flexible material and said sole comprises a second flexible material that is different from said first flexible material, and wherein said second flexible material is a durable lightweight foam material.

12. The article of footwear of claim 11, wherein said lightweight, durable foam material is an EVA foam material.

13. The article of footwear of claim 1, wherein said sole further comprises a toe plate connected to said forefoot area of said sole.

14. The article of footwear of claim 1, further comprising flexible lacing.

15. The article of footwear of claim 1, wherein said article of footwear is an athletic shoe.

16. The article of footwear of claim 11, wherein said sole further includes a plurality of laterally extending flexure lines that extend across the width of the said sole so as to divide said sole into a plurality of sole plates that flex with respect to one another, wherein said article of footwear has a natural state and a collapsed state, said collapsed state having said upper and said forefoot area of said sole sandwiched between said heel area and said arch area of said sole, whereby the plurality of sole plates move apart from each other around the outside of the shoe in said collapsed state.

17. The article of footwear of claim 11, wherein said sole further includes a plurality of laterally extending flexure lines that extend across the width of said sole so as to divide said sole into a plurality of sole plates that flex with respect to one another, wherein said article of footwear has a natural state and a collapsed state, said collapsed state having said upper and said heel area sandwiched between said forefoot area and said arch area of said sole, whereby the plurality of sole plates move apart from each other around the outside of the shoe in said collapsed state.

18. An article of footwear comprising:

an upper; and a flexible unitary sole fixed to said upper and having a forefoot area, a heel area and an arch area, and further having a length and a width, wherein said sole includes:

a first and second flexure line that each extends through at least a portion of the length of said sole along at least a portion of said forefoot area, wherein said first flexure line extends longitudinally through at least a portion of said forefoot area, said second flexure line being disposed between said first flexure line and the medial side of said sole, wherein said first and second flexure lines divide said sole at the portion of said forefoot area into first, second and third sole plates, each of the first, second and third sole plates being undivided by a flexure line, wherein the first sole plate extends from the lateral side to said first flexure line, wherein the second sole plate extends from said first flexure line to said second flexure line, and wherein the third sole plate extends from said second flexure line to the medial side of said sole, and wherein said sole includes at least one sole plate at said arch area, wherein the at least one sole plate has a ground contacting surface.

19. The article of footwear of claim 18, wherein said first flexure line extends substantially the entire length of said sole.

20. The article of footwear of claim 18, wherein said sole further includes a plurality of laterally extending flexure lines that extend across the width of said sole so as to divide said sole into a plurality of sole plates that flex with respect to one another, wherein said article of footwear has a natural state and a collapsed state, said collapsed state having said sole rolled onto itself with said forefoot area disposed adjacent said heel area and said sole enveloping said upper, whereby the plurality of sole plates move apart from each other at least one of the plurality of laterally extending flexure lines in said collapsed state.

21. The article of footwear of claim 20, wherein at least one laterally extending flexure line is located diagonally across the width of said sole so as to be slanted with respect to at least one other laterally extending flexure line.

22. The article of footwear of claim 20, wherein said natural state of said article of footwear includes a generally flat sole.

23. The article of footwear of claim 18, wherein said sole has only nine laterally extending flexure lines that extend across the width of the said sole and are disposed rearward of a front end of said sole and forward of a rear end of said sole.

24. The article of footwear of claim 18, wherein said sole further includes a lateral flexure line extending across the width of said sole at said arch area, wherein a thickness of a portion of said sole for extending beneath a wearer's foot and divided by the lateral flexure line is less than a thickness of said sole not divided by the lateral flexure line.

25. The article of footwear of claim 18, wherein said upper comprises a first flexible material and said sole comprises a second flexible material that is different from said first flexible material, and wherein said second flexible material is a durable lightweight foam material.

26. The article of footwear of claim 18, wherein said article of footwear is an athletic shoe.

27. The article of footwear of claim 1, wherein said plurality of laterally extending flexure lines divide a thickness of said sole at an angle that is substantially perpendicular relative to a bottom surface of said sole.

* * * * *